US007070636B2

(12) United States Patent
McCormick et al.

(10) Patent No.: US 7,070,636 B2
(45) Date of Patent: Jul. 4, 2006

(54) CYCLONIC VACUUM CLEANER WITH FILTER AND FILTER SWEEPER

(75) Inventors: Michael J. McCormick, Long Beach, CA (US); Henry Marcussen, Danville, KY (US); J. Erik Hitzelberger, Danville, KY (US); Tamaki Nishikori, Kusatsu (JP); Richard Eric Downey, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 399 days.

(21) Appl. No.: 10/416,663

(22) PCT Filed: Nov. 13, 2001

(86) PCT No.: PCT/US01/47401

§ 371 (c)(1),
(2), (4) Date: Sep. 12, 2003

(87) PCT Pub. No.: WO02/38025

PCT Pub. Date: May 16, 2002

(65) Prior Publication Data

US 2004/0025285 A1 Feb. 12, 2004

Related U.S. Application Data

(60) Provisional application No. 60/248,085, filed on Nov. 13, 2000.

(51) Int. Cl.

| | |
|---|---|
| ***A47L 9/16*** | (2006.01) |
| ***B01D 35/20*** | (2006.01) |
| ***B01D 45/12*** | (2006.01) |
| ***B01D 50/00*** | (2006.01) |

(52) U.S. Cl. ..... 55/299; 55/304; 55/305; 55/337; 55/477; 55/472; 55/482; 55/DIG. 3; 15/350; 15/353

(58) Field of Classification Search ..... 55/296, 55/299, 304, 305, 337, 472, 477, 482, DIG. 3; 15/350, 353

See application file for complete search history.

(56) References Cited

U.S. PATENT DOCUMENTS

| | | | | |
|---|---|---|---|---|
| 1,134,294 | A | 4/1915 | Supanz | |
| 1,993,231 | A | 3/1935 | Tunstall | |
| 2,500,747 | A | 3/1950 | Ellis | |
| 2,594,456 | A | 4/1952 | Kroenlein | |
| 2,648,396 | A | 8/1953 | Kirby | |
| 2,994,434 | A | 8/1961 | Moseres | |
| 3,113,923 | A | 12/1963 | Bingham | |
| 4,367,565 | A | 1/1983 | Parise | |
| 4,533,371 | A * | 8/1985 | Nakamura | 55/299 |
| 4,675,032 | A | 6/1987 | Genovese et al. | |
| 5,254,147 | A | 10/1993 | Finke | |
| 5,829,092 | A | 11/1998 | Hobbs | |
| 6,192,550 | B1 | 2/2001 | Hamada et al. | |
| 6,269,518 | B1 | 8/2001 | Yung | |
| 6,341,404 | B1 | 1/2002 | Salo et al. | |
| 6,436,160 | B1 * | 8/2002 | Stephens et al. | 55/337 |

FOREIGN PATENT DOCUMENTS

| | | | | |
|---|---|---|---|---|
| JP | 54123258 A * | 9/1979 | | 55/290 |

OTHER PUBLICATIONS

United States Statutory Invention Registration No. H535; Oct. 4, 1988, Sam et al., "Compact Device for Continuous Removal of Water From an Airstream-Cascade Screen".

* cited by examiner

*Primary Examiner*—Robert A. Hopkins
(74) *Attorney, Agent, or Firm*—King & Schickli, PLLC

(57) ABSTRACT

A bagless vacuum cleaner (10) includes a nozzle assembly (16) having a suction nozzle for picking up dirt and debris from a surface to be cleaned and a canister assembly (18)

including a cavity (32). A dust collection assembly (12) is received and held in that cavity (32). The dust collection assembly (12) includes a filtering subassembly (100) and a dust container (102). The dust container (102) has an open top (104), a bottom wall (106), a first cylindrical sidewall (108), an inlet (110), and a downwardly directed outlet (112) extending through the bottom wall. An airstream conduit is provided for conveying a vacuum airstream between the suction nozzle and the inlet. A filter (124, 138) is carried on the filtering subassembly (100). A sweeper (200) rotates relative to the filtering subassembly (100) to clean dirt and debris from at least a portion of the filter (138). A suction fan (34) and suction fan drive motor (35) carried on either the nozzle assembly (16) or the canister assembly (18) generates the vacuum airstream for drawing dirt and debris through the suction nozzle, the airstream conduit and the dust container (102).

29 Claims, 10 Drawing Sheets

CYCLONIC VACUUM CLEANER WITH FILTER AND FILTER SWEEPER

This is a U.S. National Stage Application of International Patent Application Serial No. PCT/US01/47401 filed Nov. 13, 2001 which claims the benefit of U.S. Provisional Application Ser. No. 60/248,085 filed Nov. 13, 2000.

TECHNICAL FIELD

The present invention relates generally to the vacuum cleaner art, and, more particularly, to a bagless vacuum cleaner incorporating a novel filter and filter sweeper cleaning system.

BACKGROUND OF THE INVENTION

A recent consumer products trend has resulted in a rapid increase in the popularity of bagless upright vacuum cleaners. Such vacuum cleaners generally incorporate a washable and rigid dust container or cup for collecting intermediate and larger particles of dirt and debris and a second, upstream corrugated paper, porous foam or like filter or filter cartridge for collecting smaller dirt and dust particles. The intermediate and larger particles of dirt and debris are collected in the dust container or cup usually by establishing a vortex airstream therein which allows the heavier particles to be separated from the airstream and collected in the bottom of the container or cup. Generally, the container or cup is made from transparent or translucent material so that the operator may observe the "cyclonic" cleaning action. This seems to add significantly to the customer satisfaction with the product. Of course, the transparent or translucent container or cup also allows the operator to confirm when the cup or container is nearing capacity. At that time the vacuum cleaner may be switched off and the cup or container removed for emptying into a garbage can or other appropriate dirt receptacle.

While many available designs exist for bagless vacuum cleaners it should be appreciated that further improvements in design including improvements in air flow so as to provide more cleaning power and more efficient operation are still desired. The present invention meets this goal.

SUMMARY OF THE INVENTION

In accordance with the purposes of the present invention as described herein, an improved bagless vacuum cleaner is provided. The bagless vacuum cleaner includes a nozzle assembly having a suction nozzle for picking up dirt and debris from a surface to be cleaned and a canister assembly including a cavity. The bagless vacuum cleaner also includes a dust collection assembly. That dust collection assembly includes a filtering subassembly and a dust container. The dust container has an open top, a bottom wall and a first cylindrical sidewall. The container also includes an inlet that in at least one embodiment is directed tangentially with respect to the first cylindrical sidewall in order to establish a vortex airstream to allow efficient cleaning action. Still further, the dust container includes a downwardly directed outlet which extends through the bottom wall of the container. The bagless dust collection assembly may be received and held in the cavity in the canister assembly.

The bagless vacuum cleaner further includes an airstream conduit for conveying a vacuum airstream between the suction nozzle and the inlet. A filter is carried on the filtering subassembly. A sweeper, carried on the filtering subassembly so as to allow rotary movement relative thereto, sweeps dirt and debris from at least a portion of the filter during the cleaning operation. Additionally, a suction fan and suction fan drive motor is carried on either the nozzle assembly or the canister assembly. The suction fan and cooperating suction fan drive motor function to generate the vacuum airstream for drawing dirt and debris through the suction nozzle, the airstream conduit and the dust container.

More specifically describing the invention, the dust container includes a second cylindrical sidewall concentrically received within the first cylindrical sidewall so that at least a portion of the dust container is annular. This second cylindrical sidewall defines an exhaust pathway which is provided in fluid communication with the outlet.

The filtering subassembly includes a main body and a cooperating cover defining a primary filter cavity. The filter includes a primary filter that is positioned in the primary filter cavity. The primary filter divides the primary filter cavity into an intake chamber and a discharge chamber. The primary filter may take the form of an annular corrugated filter made from paper or other natural and/or synthetic fiber material appropriate for the intended purpose.

The main body of the filter subassembly includes a downwardly depending exhaust conduit which provides fluid communication between the discharge chamber and the exhaust pathway leading to the outlet. Additionally, the main body includes a first conical wall around the intake chamber.

The prefilter is carried on the main body. The prefilter extends concentrically around the exhaust conduit but is spaced therefrom so as to form an intake channel between the prefilter and the exhaust conduit. The intake channel is provided in fluid communication with the intake chamber. The prefilter may take the form of a cylindrical open-ended screen or it may be made of porous plastic.

An air current guide may be carried on the main body adjacent the prefilter. The air current guide extends between the prefilter and the second cylindrical sidewall. The air current guide includes a disc-like separator and at least one downwardly depending air current guide vane.

Once fully assembled a first gap having a width $W_1$ is formed between the prefilter and the first cylindrical sidewall of the dust container. Additionally, a second gap having a width $W_2$ is provided between an outer edge of the separator and the first cylindrical sidewall. A third gap having a width $W_3$ is provided between the sweeper and the first cylindrical sidewall. Further, the inlet includes a diameter $D_1$. Typically $D_1 \leqq W_1$ and $W_2 \leqq W_3$ with $W_1$ being between 34–36 mm, $W_2$ being between 12–16 mm, $W_3$ being between 14–20 mm and $D_1$ being between 30–35 mm.

The vacuum cleaner also includes a filter clicker carried on the cover of the filtering subassembly. The filter clicker includes a cleaning element having at least one projecting lug and an actuator for rotating the cleaning element relative to the primary filter. The primary filter preferably includes a frame for supporting the corrugated filter material. A series of projecting tabs extend from the frame. The projecting lug on the cleaning element engages the series of projecting tabs on the frame vibrating the frame and filter material held by the frame and thereby cleaning dirt from the primary filter when the actuator is manually manipulated.

In addition, the present invention may be described as relating to a novel bagless upright vacuum cleaner. The bagless upright vacuum cleaner includes a nozzle assembly having a suction nozzle for picking up dirt and debris from a surface to be cleaned and a canister assembly pivotally mounted to the nozzle assembly and including a control handle. The upright vacuum cleaner also includes a washable dust container and a filter for collecting dirt and debris cleaned from the surface. A sweeper cleans at least a portion of the filter during operation. A suction fan and beltless suction fan drive motor carried on the nozzle assembly or the canister assembly generates a vacuum airstream for drawing dirt and debris through the suction nozzle into the dust container.

Still other objects of the present invention will become readily apparent to those skilled in this art from the following description wherein there is shown and described a preferred embodiment of this invention simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
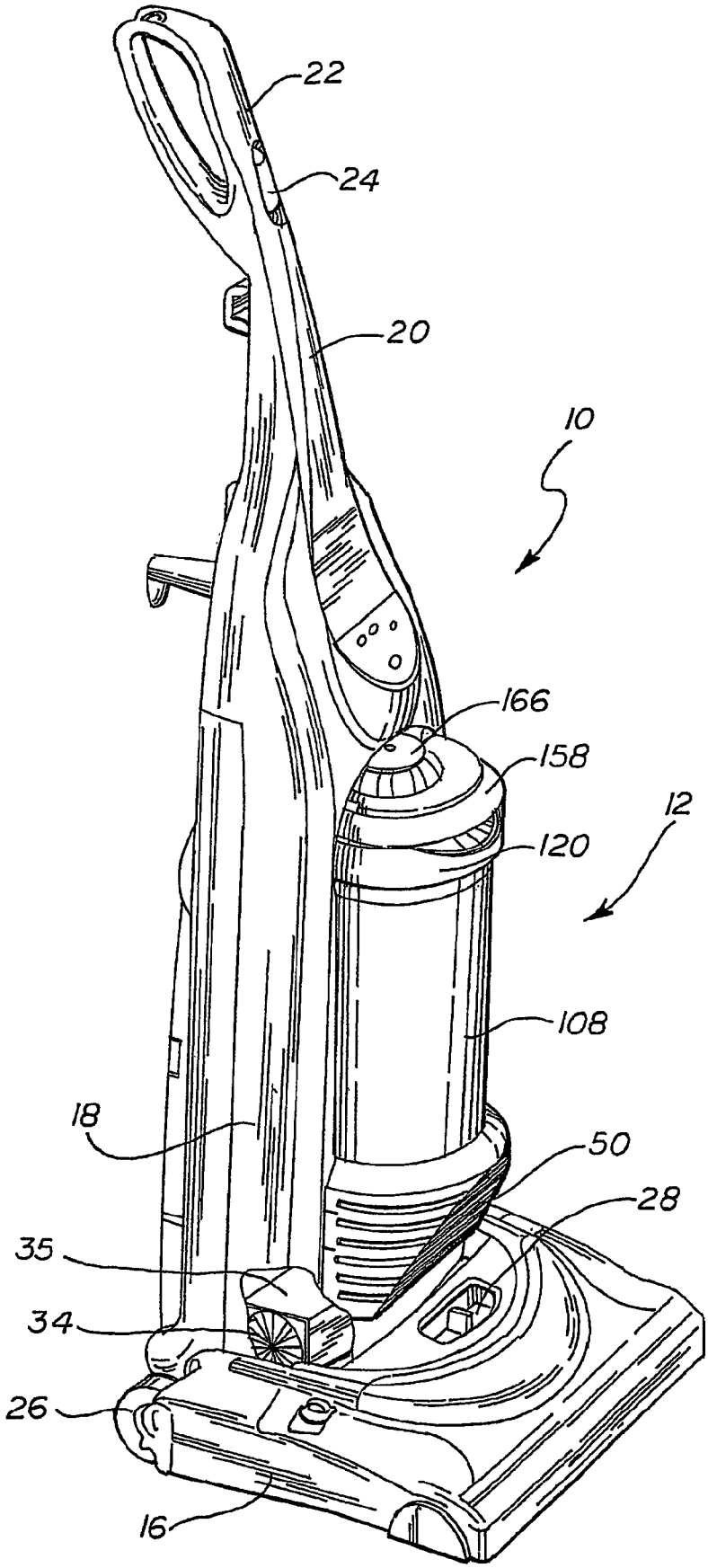
FIG. 1 is a perspective view of a vacuum cleaner constructed in accordance with the teachings of the present invention.

Reference is now made to FIG. 1 showing the vacuum cleaner 10 of the present invention. It should be appreciated that while an upright vacuum cleaner 10 is illustrated, embodiments of the present invention also include canister vacuum cleaners incorporating a dust collection assembly 12 of the nature that will be described in detail below.

The upright vacuum cleaner 10 illustrated includes a nozzle assembly 16 and a canister assembly 18. The canister assembly 18 further includes a control handle 20 and a hand grip 22. The hand grip 22 carries a control switch 24 for turning the vacuum cleaner on and off. Of course, electrical power is supplied to the vacuum cleaner 10 from a standard electrical wall outlet through a cord (not shown).

At the lower portion of the canister assembly 18, rear wheels 26 are provided to support the weight of the vacuum cleaner 10. A second set of wheels 27 (see also FIG. 2) allow the operator to raise and lower the nozzle assembly 16 through selective manipulation of the height adjustment switch 28. Such a height adjustment mechanism is well known in the art and is exemplified, for example, by the arrangement incorporated into the Kenmore Progressive Vacuum Cleaner presently in the marketplace. To allow for convenient storage of the vacuum cleaner 10, a foot latch (not shown) functions to lock the canister assembly 18 in an upright position as shown in FIG. 1. When the foot latch is released, the canister assembly 18 may be pivoted relative to the nozzle assembly 16 as the vacuum cleaner 10 is manipulated to-and-fro to clean the floor.

The canister assembly 18 includes a cavity 32 (see also FIGS. 5*a* and 5*b*) adapted to receive and hold the dust collection assembly 12. Additionally, the canister assembly 18 carries a suction fan 34 and suction fan drive motor 35. Together, the suction fan 34 and its cooperating drive motor 35 function to generate a vacuum airstream for drawing dirt and debris from the surface to be cleaned. While the suction fan 34 and suction fan drive motor 35 are illustrated as being carried on the canister assembly 18, it should be appreciated that they could likewise be carried on the nozzle assembly 16 if desired.

The nozzle assembly 16 includes a nozzle and agitator cavity 36 that houses a rotating agitator brush 38. The agitator brush 38 shown is rotatably driven by a motor 40 and cooperating gear drive 42 housed within the agitator and described in greater detail below (see FIGS. 2 and 2*a*). In the illustrated vacuum cleaner 10, the scrubbing action of the rotary agitator brush 38 and the negative air pressure created by the suction fan 34 and drive motor 35 cooperate to brush and beat dirt and dust from the nap of the carpet being cleaned and then draw the dirt and dust laden air from the agitator cavity 36 to the dust collection assembly 12. Specifically, the dirt and dust laden air passes serially through a suction inlet and hose and/or an integrally molded conduit in the nozzle assembly 16 and/or canister assembly 18 as is known in the art. Next, it is delivered into the dust collection assembly 12 (described in greater detail below) which serves to trap the suspended dirt, dust and other particles inside while allowing the now clean air to pass freely through to the suction fan 34, a final filtration cartridge 48 and ultimately to the environment through the exhaust port 50.

Figure 2:
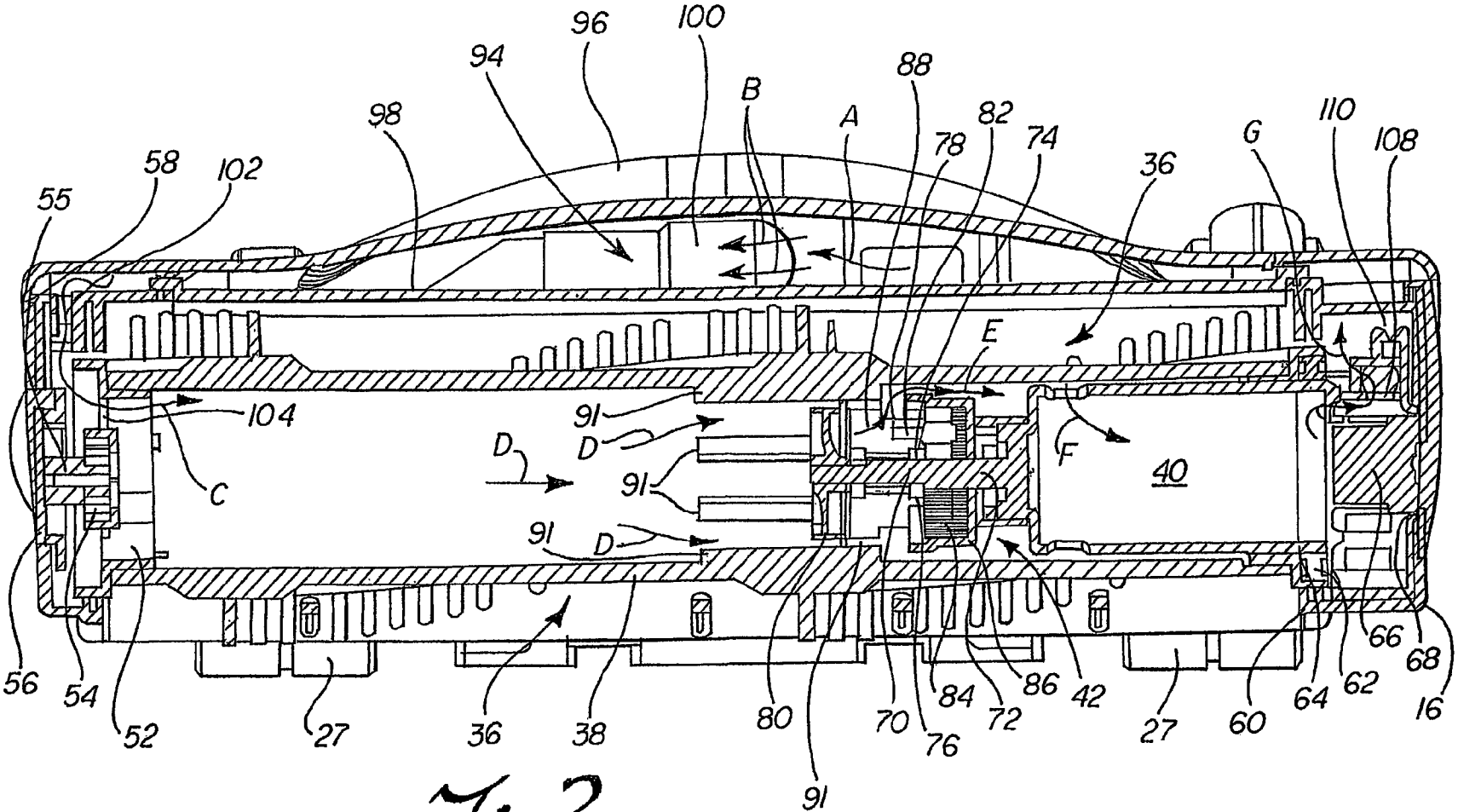
FIG. 2 is a cross-sectional view through the nozzle assembly of the vacuum cleaner showing the agitator and agitator drive arrangement.
Figure 2A:
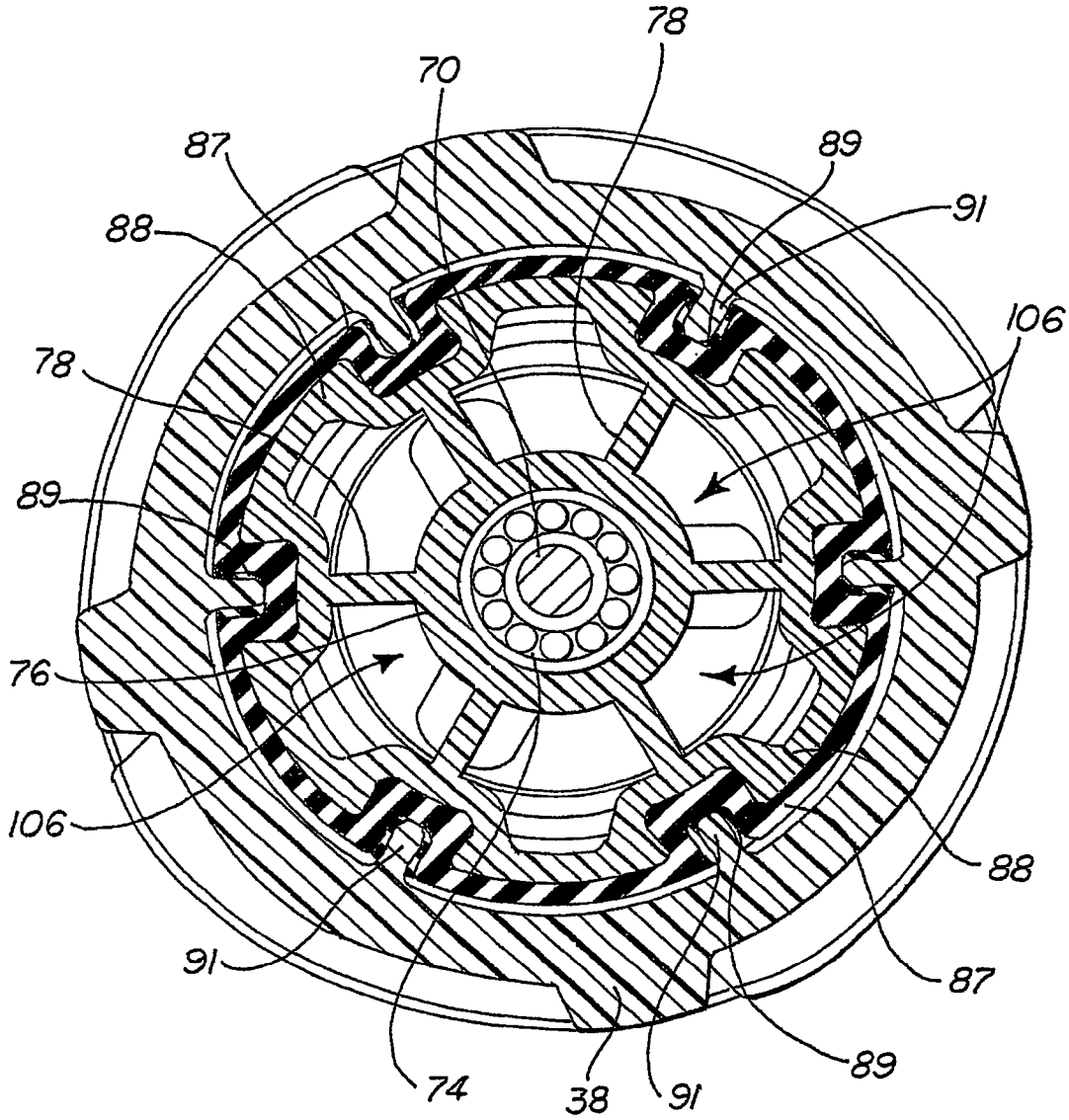
FIG. 2*a* is a detailed cross-sectional view through the agitator.

Reference is now made to FIGS. 2 and 2*a* which show the mounting of the agitator motor 40 and associated gear drive 42 in the agitator 38 in detail. As shown, the agitator 38 is mounted for rotation relative to the nozzle assembly 16. Specifically, a first end of the agitator 38 includes an end cap 52 which is supported on bearings 54 on a stub shaft 55 held in mounting block 56 keyed into slot 58 in the side of the nozzle assembly 16. An end cap 60 at the opposite end of the agitator 38 is supported on bearings 62 mounted on the housing 64 of the motor 40. As should be appreciated, the motor 40 is fixed to the nozzle assembly 16 by means of the mounting block 66 fixed to the motor housing 64 and keyed in the slot 68 in the side of the nozzle assembly.

The motor 40 drives a shaft 70 including gear teeth 72. The drive shaft 70 extends through a bearing 74 held in the hub 76 of the planetary gear set carrier 78. In the most preferred embodiment a fan 80 is keyed or otherwise secured to the distal end of the drive shaft 70.

The planetary gear set carrier 78 includes three stub shafts 82 that each carry a planetary gear 84. Each of the planetary gears 84 include teeth that mesh with the gear teeth 72 of the drive shaft 70. Additionally, the planetary gears 82 mesh with the teeth of an annular gear 86 that is fixed to the agitator motor housing 64 by pin or other means. Thus, it should be appreciated that as the drive shaft 70 is driven by the motor 40, the planetary gears 84 are driven around the annular gear 86, thereby causing the planetary gear set carrier 78 to rotate.

Planetary gear set carrier 78 also includes a drive ring 88 and associated rubber drive boot 87 which includes a series of spaced channels 89 that receive and engage axial ribs 91 projecting inwardly radially from the inner wall of the agitator 38. Thus, the rotation of the planetary gear set carrier 78 is transmitted by the drive ring 88 and drive boot 87 directly to and causes like rotation of the agitator 38. The rubber drive boot 87 provides the necessary damping to insure the smooth transmission of power to the agitator 38. Simultaneously with the rotation of the planetary gear set carrier 78 and agitator 38, the drive shaft 70 also drives the fan 80 at a ratio of between 4-1 to 10-1 and most preferably 6-1 with respect to the agitator 38. The resulting rapid rotation of the fan 80 helps to move air through the agitator 38 and ensure proper cooling of the agitator motor 40 during its operation.

The dust collection assembly 12 will now be described in detail. The dust collection assembly 12 includes a filtering subassembly generally designated by reference numeral 100 and a dust container 102. Dust container 102 includes an open top 104, a bottom wall 106 and a first cylindrical sidewall 108. An inlet 110 is shown directed tangentially with respect to the cylindrical sidewall 108. In this orientation, the inlet 110 promotes the formation of a vortex airstream as described in greater detail below. It should be appreciated, however, that substantially any other inlet orientation could be utilized and the formation of a vortex airstream is not critical to the present invention.

Figure 3:
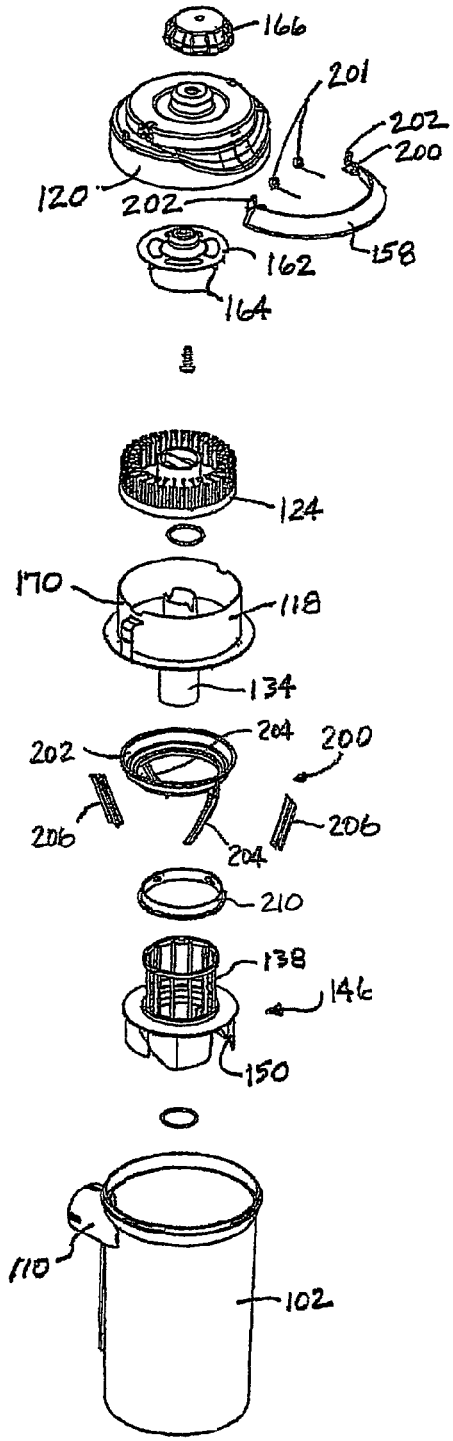
FIG. 3 is an exploded perspective view of the dust collection assembly incorporated into the vacuum cleaner of the present invention.

A downwardly directed outlet 112 extends through the bottom wall 106. A second or inner cylindrical sidewall 114 is concentrically received within the first cylindrical sidewall 108 so that at least a portion of the dust container 102 is annular. As best shown in FIG. 3, the second cylindrical sidewall 114 defines an exhaust passageway 116 provided in fluid communication with the outlet 112.

The filtering subassembly 100 includes a main body 118 and a cooperating cover 120 which seats on the dust container 102 and closes the open top 104. Together the main body 118 and cooperating cover 120 define a primary filter cavity 122. A primary filter 124 is positioned in the primary filter cavity 122 and divides that cavity into an intake chamber 126 and a discharge chamber 128. In one embodiment, the primary filter 124 is an annular corrugated filter made from paper or other natural and/or synthetic fiber material with each of the corrugations held by a plastic frame 130. That frame 130 includes a series of upwardly projecting tabs 132 radially arranged about the primary filter 124.

The main body 118 includes a downwardly depending exhaust conduit 134 providing fluid communication between the discharge chamber 128 and the exhaust pathway 116 leading to the outlet 112. As also shown the main body 118 includes a frustoconical wall 136 defining the peripheral margin of the intake chamber 126.

A prefilter 138 is carried on the main body 118 below the frustoconical wall 136. The prefilter 138 is shown as comprising a cylindrical open-ended screen supported on a molded plastic frame 139. The prefilter 138 extends concentrically around the exhaust conduit 134 so as to form an intake channel 140 between the prefilter and the exhaust conduit. Of course, other materials such as a porous plastic could be used for the prefilter 138. The intake channel 140 is provided in fluid communication with the intake chamber 126 through spaced openings 142 in the base 144 of the main body 118.

Figure 4:
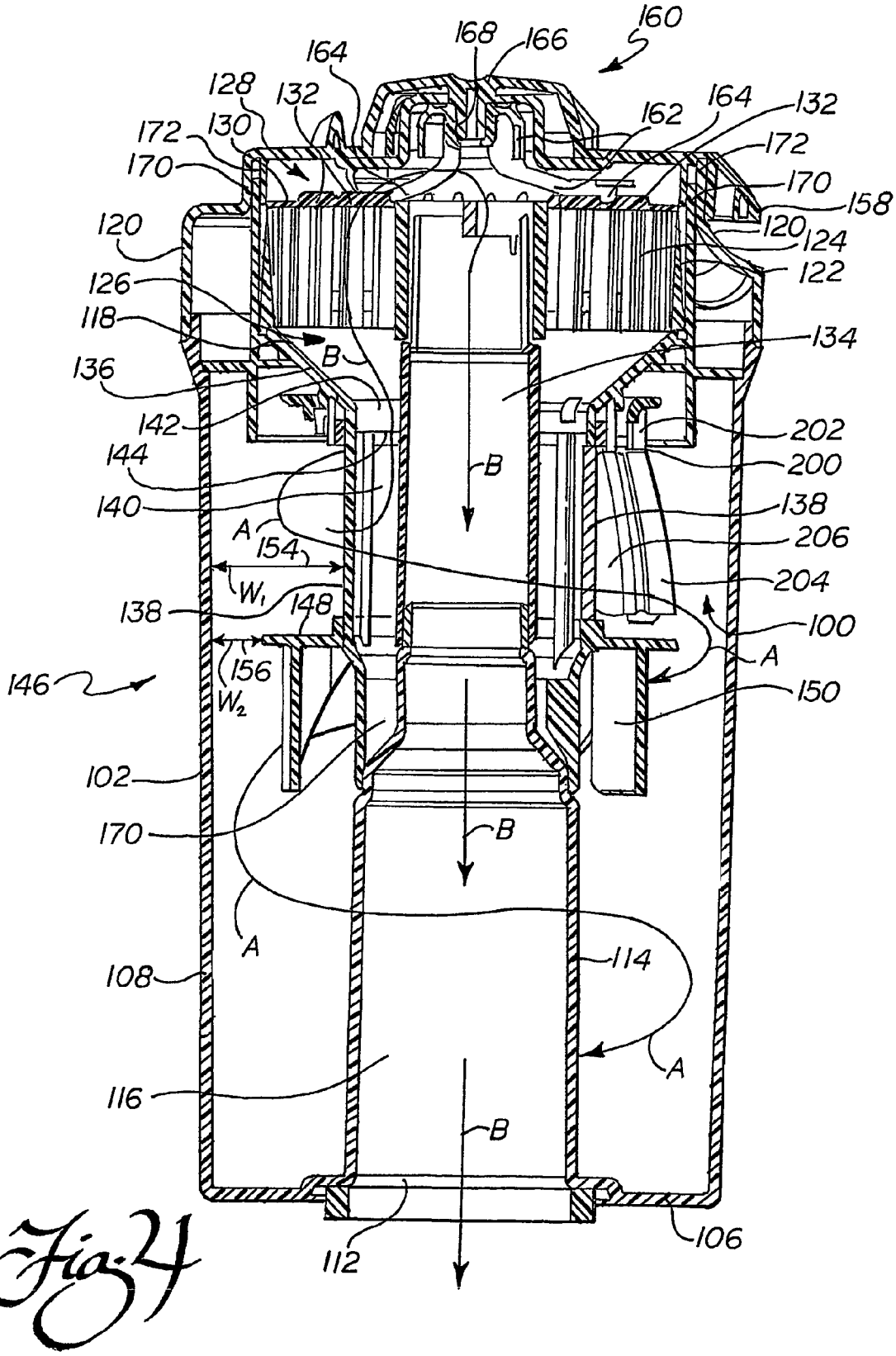
FIG. 4 is a cross-sectional view of the dust collection assembly.

As further shown in FIGS. 3 and 4, an air current guide, generally designated by reference numeral 146 is carried by the main body 118 adjacent the prefilter 138. The air current guide 146 extends between the prefilter 138 and the second cylindrical sidewall 114 of the dust container 102. As shown the air current guide 146 includes a disc shaped separator 148 and one or more downwardly depending air current guide vanes 150. The function of the separator 148 and guide vanes 150 will be described in greater detail below.

In operation, dirt and debris lifted by the agitator brush 38 and drawn through the suction inlet and hose passes through the inlet 110. In the illustrated embodiment, inlet 110 directs the air to tangentially flow in a cyclonic path (note action arrows A in FIG. 3) around the dust container 102. Specifically, the air first flows around a prefilter 138 with the heavier debris falling under the force of gravity toward the bottom of the dust container 102. The air current guide vane 150 helps maintain smooth, uninterrupted and unturbulent cyclonic flow in order to maximize cleaning action. The largest and heaviest of the dirt and debris entrained in the vacuum airstream delivered into the dust container 102 through the inlet 110 settles to the bottom wall 106 of the dust container.

The vacuum airstream now devoid of the relatively larger and heavier dust, debris and particles is drawn through the filter screen 138 into the intake channel 140. The screen includes pores having a diameter of between substantially 40 μm and 300 μm. Relatively intermediate size dust, dirt and debris too light to settle to the bottom of the dust container 102 but too large to pass through the filter screen 138 is removed from the vacuum airstream by the filter screen. There this material collects and gradually accumulates into a heavier mass which is eventually swept away by the sweeper 200 so that it drops down into the bottom of the dust container 102.

Figure 6:
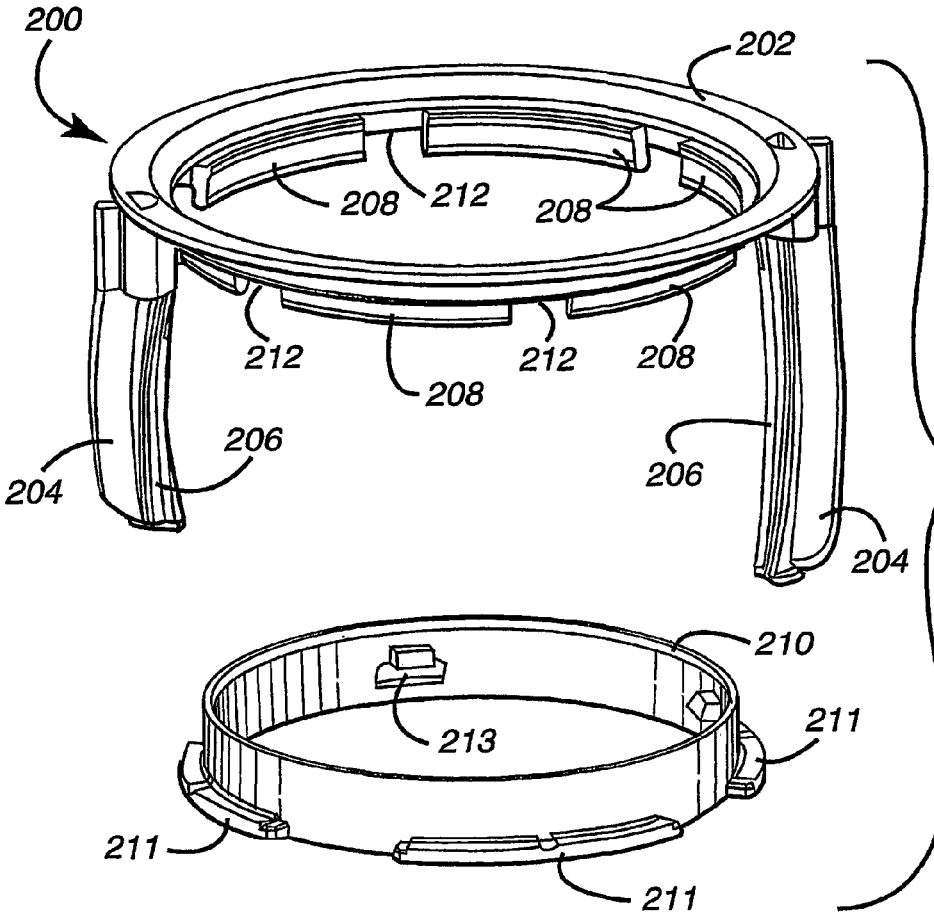
FIG. 6 is a detailed, exploded perspective view of the sweeper including a wiper for cleaning the filter screen and the stationary bearing upon which the sweeper revolves showing the cooperating slots that allow the passage of dirt and debris from the structure.
Figure 7A:
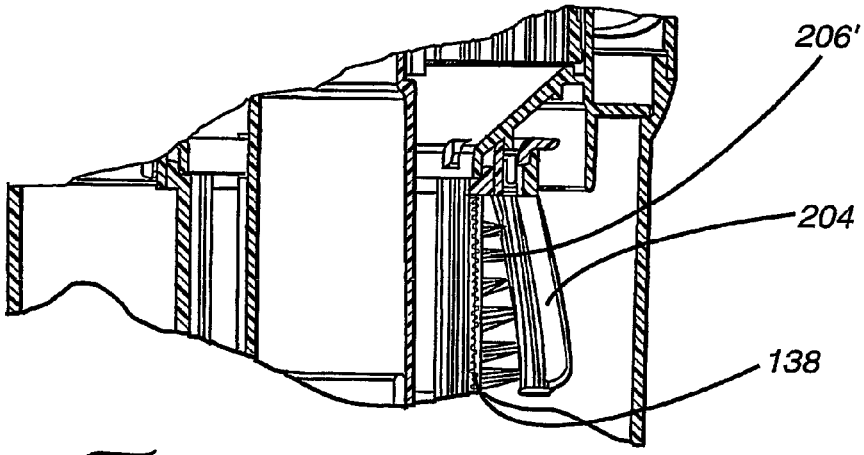
FIGS. 7*a*–7*c* are fragmentary views similar to FIG. 4 showing alternative embodiments of the sweeper including, respectively, tufted bristles, a bristle brush and a notched blade or comb instead of a wiper for cleaning the filter screen.
Figure 7B:
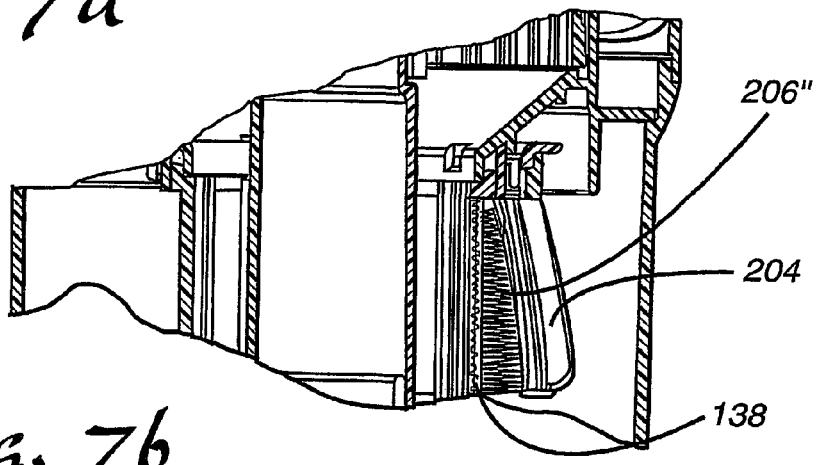
Figure 7C:
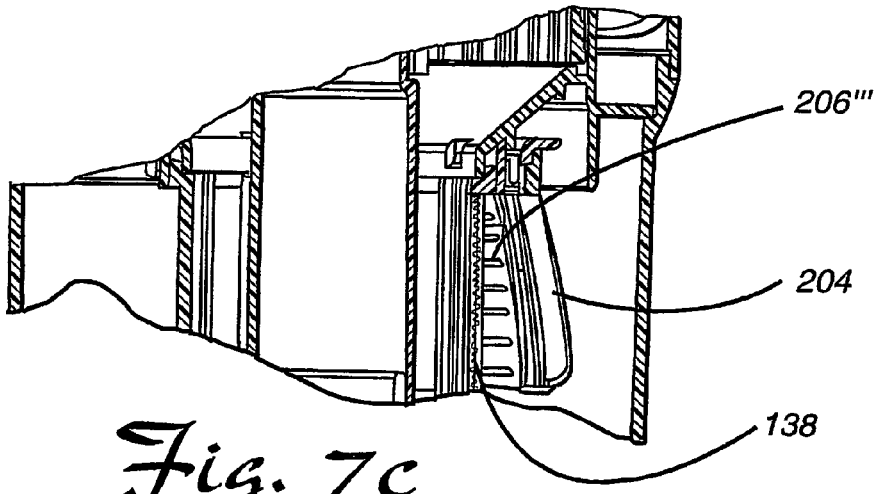

As best shown with reference to FIG. 6, the sweeper 200 includes a rotor 202 and at least one downwardly depending blade 204. Two blades 204 are shown in the drawing figure but more or less could be provided if desired. Each blade 204 may carry a wiper 206 that may be formed from rubber, plastic, felt or any other appropriate material suitable for sweeping dirt and debris from the filter screen 138 in the manner described below. Of course, the wiper 206 could be replaced with tufted bristles 206', a bristle brush 206", a notched blade or a comb 206''' (see FIGS. 7*a*–7*c*) or any other structure capable of performing the cleaning function described.

Figure 6A:
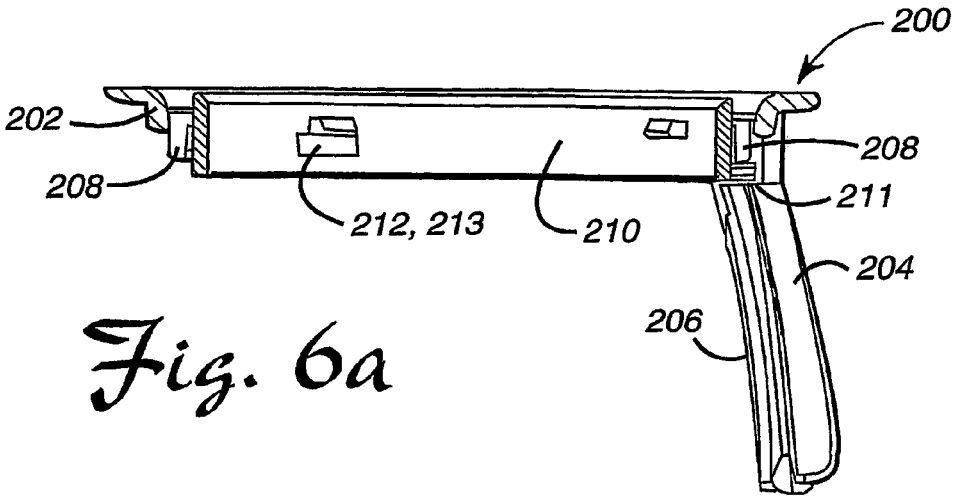
FIG. 6*a* is a detailed cross sectional view of the rotor of the sweeper on the stationary bearing.

In the embodiment illustrated, the rotor 202 rides on a stationary bearing collar 210 (see FIGS. 6 and 6*a*). More specifically, the rotor 202 includes a downwardly projecting shoulder 208. The bearing collar 210 includes a series of spaced bearing lugs 211. The lower edge of the shoulder 208 rests on the lugs 211 so that the rotor 202 is concentrically disposed about the bearing collar 210.

As further shown, the shoulder 208 is interrupted at spaced points so as to provide a series of gaps or slots 212. The bearing collar 210 includes at least one or more slots 213. As the rotor 202 rotates on and around the stationary bearing collar 210, the slots 212 in the rotor 202 and the slot or slots 213 in the bearing collar align momentarily to provide a passageway for dirt and debris to be drawn by vacuum force from the bearing area. Accordingly, the sweeper 200 rotates freely around the main body 118 of the filtering subassembly 100 under substantially any foreseeable operating conditions. The sweeper 200 is driven around the main body 118 by the movement of air along the path A. Specifically, the blades 204 are characterized by a swept configuration that aids in driving the sweeper 200 forward while also forcing dirt and debris swept by the wiper 206 from the filter screen 138 downward into the bottom of the dust container 102. The swept angle ranges between about 0–30° over a radius of curvature of between about 35–40 mm.

As best shown by action arrow B (see FIG. 4), the vacuum airstream moving through the filter screen 138 into the intake channel 140 is then drawn through one of the apertures 142 in the main body 118 into the intake chamber 126. From the intake chamber 126 the vacuum airstream is drawn upwardly through the primary filter 124 which removes substantially all of the remaining fine dust from the airstream. Next the vacuum airstream is drawn into the discharge chamber 128. From there the vacuum airstream is redirected downwardly through the exhaust conduit 134 and then the exhaust passageway 116 to the outlet 112. From there the airstream passes through a foam or sponge rubber filter pad 152 carried at the bottom wall of the cavity 32 in the canister assembly 18. That filter pad 152 covers the inlet to a passageway (not shown) leading to the suction fan 34. From there the vacuum airstream is exhausted over the suction fan drive motor 35, to provide cooling and is delivered through a sound muffling passageway to the final filtration cartridge 48 and then it is exhausted through the exhaust port 50.

The flow of the vacuum airstream is carefully shaped and controlled throughout its passage through the vacuum cleaner 10 in order to ensure the highest possible cleaning efficiency. Toward this end a first gap 154 having a width $W_1$ of between about 34 mm and 36 mm is provided between the filter screen 138 and the first cylindrical sidewall 108. The inlet 110 is provided with a diameter $D_1$ of between about 30 mm–35 mm. In one possible embodiment diameter $D_1 \leqq$ the width $W_1$.

Additionally, a second gap 156 having a width $W_2$ between about 12 mm and 16 mm is provided between an outer edge of the separator 148 and the first cylindrical sidewall 108. The width $W_2$ of the gap 156 must be carefully controlled as it allows the separator 148 to concentrate the vacuum airflow from the inlet 110 in the area of the filter screen 138 away from the dirt and debris collecting in the bottom of the dust container 102. This is done while simultaneously maintaining a sufficiently large gap 156 to allow the free passage of the larger, heavier dirt and dust particles entrained in the airstream into the lower portion of the dust container 102 where they can be collected.

A third gap 157 having a width $W_3$ between about 14–20 mm is provided between the sweeper 200 and the first cylindrical sidewall 108. In one possible embodiment the width $W_2 \leqq$ the width $W_3$.

During vacuuming, the dust container 102 will gradually fill with dirt and debris which will also collect on the filter screen 138. Further, fine dust particles will be collected on the primary filter 124. By forming the dust container 102 and the cover 120 of the filtering subassembly 100 from transparent or translucent plastic material it is possible to visually monitor and inspect the condition of the dust container and primary filter 124 during vacuuming. Following vacuuming or as otherwise necessary it is easy to dispose of this dirt and debris. Specifically, the vacuum cleaner is turned off and the dust collection assembly 12 is removed from the cavity 32 in the canister assembly 18. This may be done by releasing a latch handle 158 (note: unlatched and latched handle positions shown, respectively in FIGS. 5*a* and 5*b*) or by simply pulling the dust collection assembly 12 from its nested position if no latch is provided. The latch handle 158 is pivotally connected to the cover 120 and serves as a simple and convenient means of handling the dust collection assembly 12.

A filter clicker, generally designated by reference numeral 160, allows easy cleaning of the primary filter 124. More specifically, the filter clicker 160 includes a revolving cleaning element 162 shown with a pair of projecting lugs 164. An exposed actuator 166 is carried on the top of the cover 120. The actuator 166 includes a hub 168 which projects through an opening in the cover 120 and engages in a cooperating socket provided in the cleaning element 162. By manually rotating the actuator 166, the cleaning element 162 is likewise rotated and the projecting lugs 164 engage with each of the series of projecting tabs 132 on the frame 130 of the primary filter 124. As the projecting lugs 164 resiliently snap past the projecting tabs 132, the corrugated filter material is vibrated shaking the fine dust and dirt particles from the primary filter 124. Since the projecting tabs 132 are provided around the outer margin of the frame, greater vibration is produced for better cleaning action. These dust and dirt particles then drop under the force of gravity and slide down the frustoconical sidewall 136 of the main body, pass through the apertures 142 and drop down into the bottom 170 of the intake channel 140 where they are captured.

The cover 120 is then removed from the dust container 102 by twisting. When separated the filtering subassembly 100 including the main body 118, cover 120, primary filter 124, filter screen 138 and air current guide 146 stay together as a unit. As the filtering subassembly 100 and the dust container 102 are separated, the bottom 170 of the intake channel 140 opens and the fine dirt and debris that is collected there from the cleaning of the primary filter 124 falls under the force of gravity into the bottom of the dust container 102. Similarly, any relatively light dirt and debris remaining on the filter screen 138 or the upper ledge of the separator 148 falls easily to the bottom of the container with minor shaking of the filtering subassembly 100 during its removal from the container. The dirt and debris is then dumped from the container 102 into a garbage receptacle. The filtering subassembly 100 is then rejoined with the dust container 102 by twisting the cover 120 onto the threaded upper end of the dust container 102 and the entire dust collection assembly 112 is then repositioned in the cavity 32 in the canister assembly 18. This positions the inlet 110 in communication with a coupling 47 in communication with the hose or other conduit leading to the nozzle and the outlet 112 in communication with the port 113 communicating with the passageway 115 leading to the suction fan 34 (see FIGS. 5*a* and 5*b*).

Under certain circumstances, such as after extended heavy duty service, it may become necessary to access the primary filter 124. This is relatively easily accomplished. More particularly, the main body 118 and the cover 120 of the filtering subassembly 100 are connected together by means of the upstanding mounting flange 170 on the main body which provides either a threaded or a fiction fit in the cooperating groove 172 of the cover 120. Accordingly, the cover 120 may be pulled or unscrewed from the main body 118 to open the primary filter cavity 122. The primary filter 124 is then replaced with a new filter. The cover 120 is then repositioned on the main body 118 by inserting the mounting flange 170 in the cooperating groove 172 and completing the reconnection.

Figure 8:
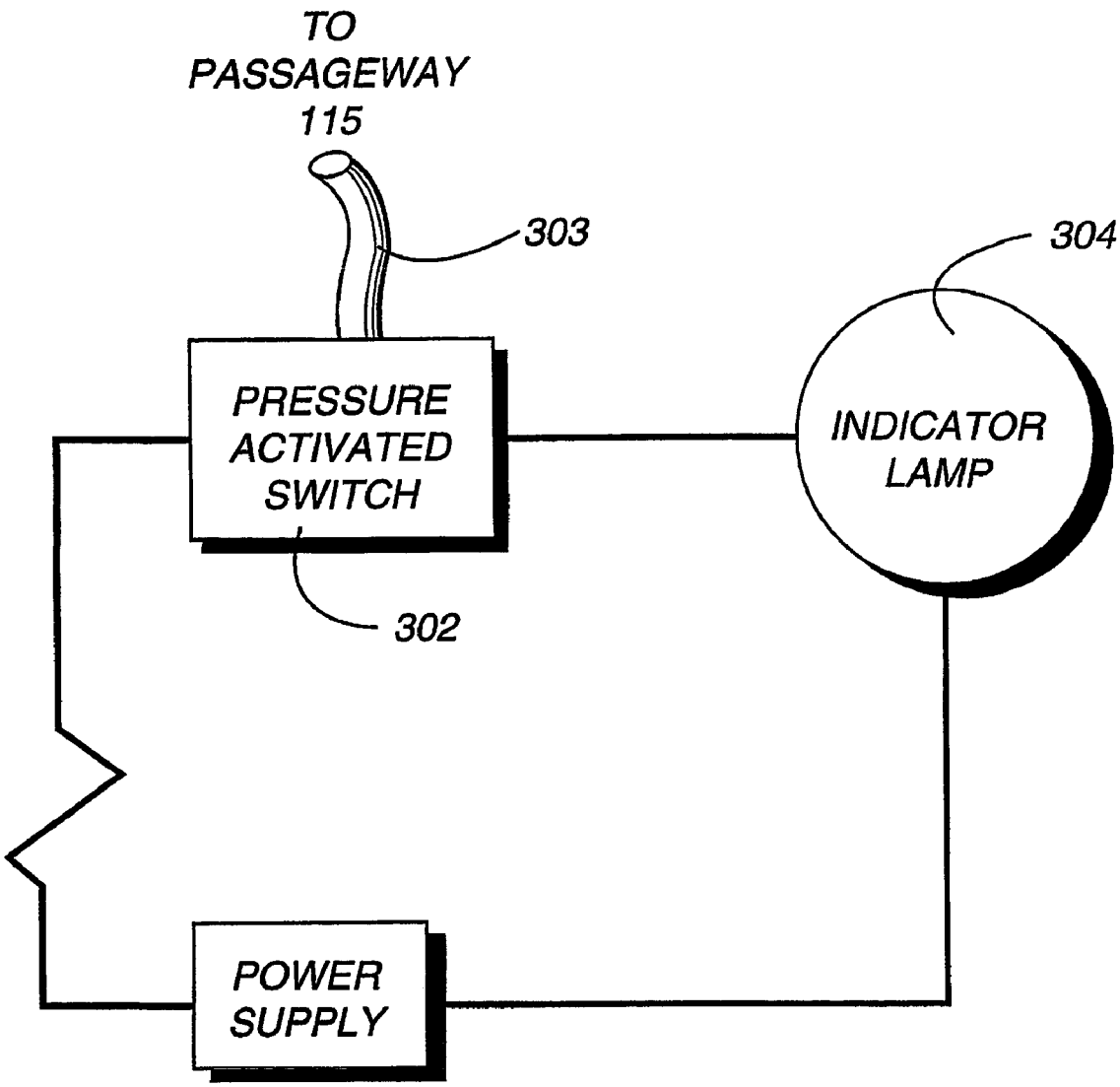
FIG. 8 is a schematical illustration of a performance indicator of the type that may be optionally included as part of the vacuum cleaner of the present invention.

As an additional optional feature, the vacuum cleaner 10 could be equipped with a performance indicator 300 (see FIG. 8) of a type such as presently found on the Kenmore Model 38912 upright vacuum cleaner. The performance indicator 300 comprises a pressure activated switch 302 which activates an indicator lamp 304 such as an LED or neon lamp when the contacts of the switch close. The pressure activated switch 302 monitors the air pressure in the vacuum fan motor air path between the primary filter 124 and the suction fan 34 such as in the passageway 115 leading from the outlet 112 to the suction fan.

In the event intake air flow becomes restricted due, for example, to an excessively dirty primary filter 124, negative pressure builds in the passageway 113. The encapsulated pressure switch 302 senses the vacuum via, for example, a non-collapsing tube 303 (see also FIG. 5*a*) and at a predetermined level closes the switch contacts. This illuminates the indicator lamp 304. The pressure required to activate the switch is calibrated for use specifically for this application.

Figure 5A:
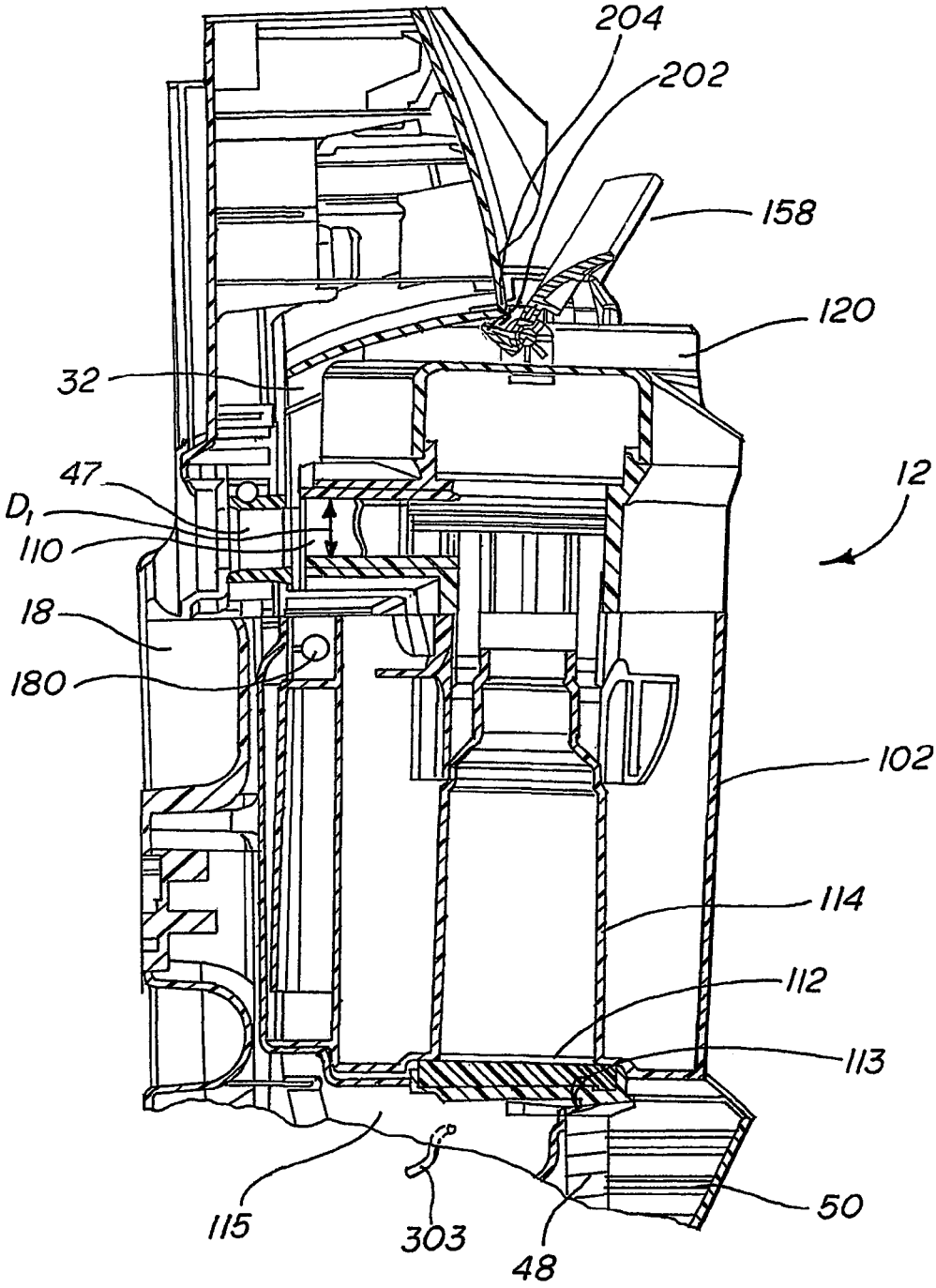
FIGS. 5*a* and 5*b* are cutaway, cross-sectional views through the canister assembly showing the latch handle in the unlatched and latched positions respectively.
Figure 5B:
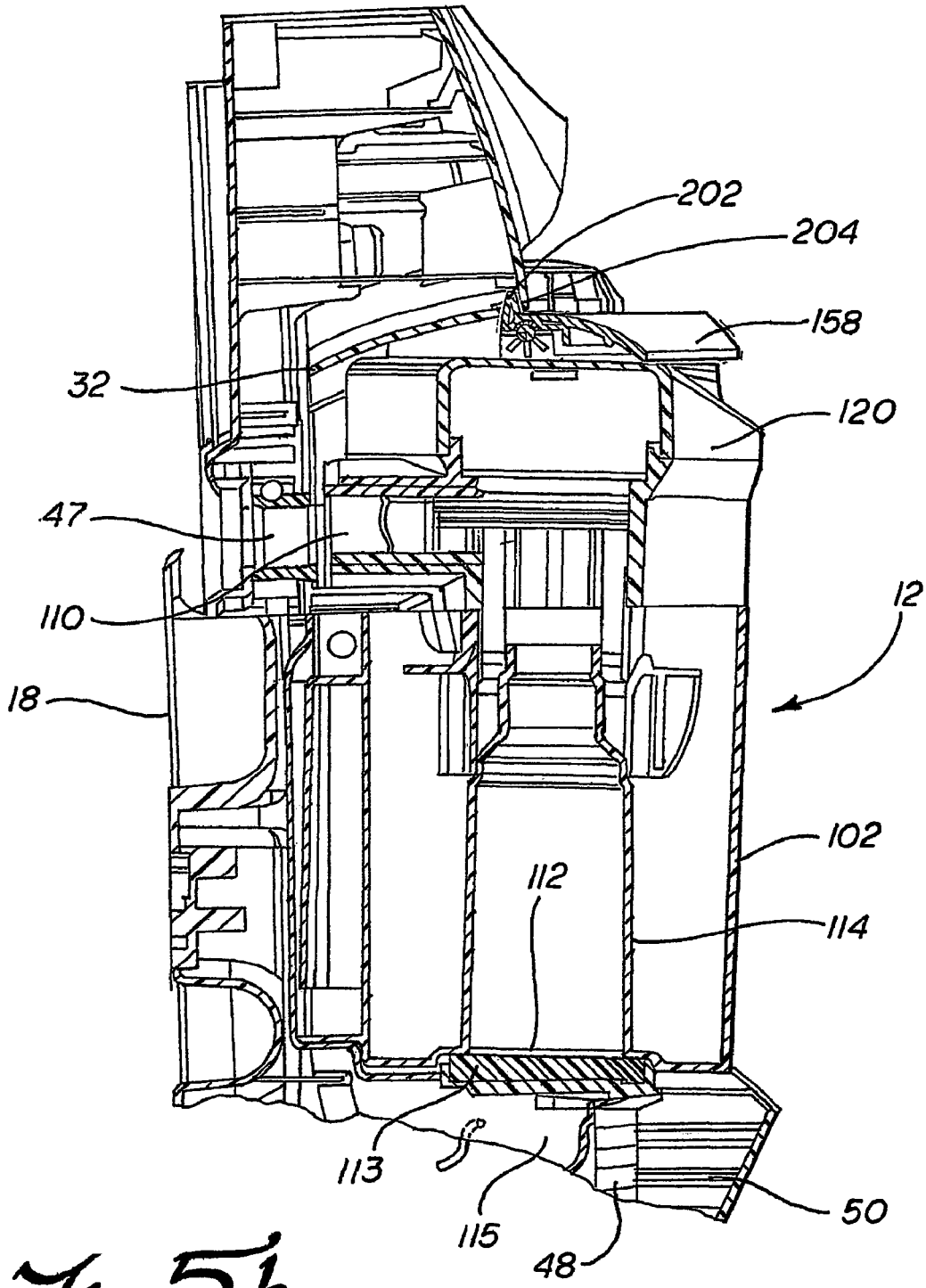

The foregoing description of the preferred embodiment of this invention has been presented for purposes of illustration and description. It is not intended to be exhaustive or to limit the invention to the precise form disclosed. Obvious modifications or variations are possible in light of the above teachings. For example, as shown in FIG. 5*a*, a back light 180 (e.g., incandescent, flourescent, neon) could be provided between the dust collection assembly 12 and the canister assembly 18 to visually enhance monitoring of the airflow and/or dirt level in the dust container 102. That back light 180 may be mounted to the canister assembly 18 as illustrated or the dust collection assembly 12 if desired. The vacuum cleaner 10 could also include a bypass valve (not shown) in the airstream conduit upstream from the inlet 110. The valve could be spring loaded to permit only high velocity air flow into the dust container 102. Further, while the vacuum cleaner is described with an agitator drive motor held in the agitator, the drive motor could be positioned outside of the agitator in either the nozzle assembly or the canister assembly in any manner desired.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed:

1. A bagless vacuum cleaner, comprising:

a nozzle assembly including a suction nozzle for picking up dirt and debris from a surface to be cleaned;

a canister assembly;

a dust collection assembly including a filtering subassembly and a dust container, said dust container having an open top, a bottom wall, a first cylindrical sidewall, an inlet, and a downwardly directed outlet extending through said bottom wall, said dust collection assembly being received and held on one of said nozzle assembly and said canister assembly;

an airstream conduit for conveying a vacuum airstream between said suction nozzle and said inlet;

a filter carried on said filtering subassembly;

a sweeper carried on said filtering subassembly so as to allow relative rotary movement with respect to said filtering subassembly, said sweeper cleaning dirt and debris from at least a portion of said filter; and a suction fan and suction fan drive motor carried on one of said nozzle assembly and said canister assembly for generating said vacuum airstream.

2. The vacuum cleaner of claim 1 wherein said dust container includes a second cylindrical sidewall concentrically received within said first cylindrical sidewall so that at least a portion of said dust container is annular.

3. The vacuum cleaner of claim 2, wherein said second cylindrical sidewall defines an exhaust pathway in fluid communication with said outlet.

4. The vacuum cleaner of claim 3, wherein said filtering subassembly includes a main body and a cooperating cover defining a primary filter cavity.

5. The vacuum cleaner of claim 4, wherein said filter includes a primary filter positioned in said primary filter cavity and dividing said primary filter cavity into an intake chamber and a discharge chamber.

6. The vacuum cleaner of claim 5, wherein said primary filter is an annular corrugated material filter.

7. The vacuum cleaner of claim 5, wherein said main body includes a downwardly depending exhaust conduit providing fluid communication between said discharge chamber and said exhaust pathway leading to said outlet.

8. The vacuum cleaner of claim 7, wherein said main body includes a frustoconical wall around said intake chamber.

9. The vacuum cleaner of claim 8, wherein said filter also includes a prefilter carried on said main body, said prefilter extending concentrically around said exhaust conduit so as to form an intake channel between said prefilter and said exhaust conduit, said intake channel being in fluid communication with said intake chamber.

10. The vacuum cleaner of claim 9, wherein said prefilter is a cylindrical, open ended screen or porous material.

11. The vacuum cleaner of claim 9, further including an air current guide carried on said main body and extending between said prefilter and said second cylindrical sidewall.

12. The vacuum cleaner of claim 11, wherein said air current guide includes a separator and at least one downwardly depending air current guide vane.

13. The vacuum cleaner of claim 6, further including a filter clicker carried on said cover, said filter clicker including a cleaning element having at least one projecting lug and an actuator for rotating said cleaning element relative to said primary filter and wherein said primary filter includes a support frame having a series of projecting tabs, said projecting lug engaging said series of projecting tabs to vibrate and clean dirt from said primary filter.

14. The vacuum cleaner of claim 12, wherein a first gap having a width $W_1$ is formed between said prefilter and said first cylindrical sidewall.

15. The vacuum cleaner of claim 14, wherein a second gap having a width $W_2$ is provided between an outer edge of said separator and said first cylindrical sidewall.

16. The vacuum cleaner of claim 15, wherein a third gap having a width $W_3$ is provided between said sweeper and said first cylindrical sidewall.

17. The vacuum cleaner of claim 16, wherein said inlet includes a diameter $D_1$ and $D_1 \leqq W_1$ and $W_2 \leqq W_3$.

18. The vacuum cleaner of claim 17, wherein $W_1$ is between 34–36 mm, $W_2$ is between 12–16 mm, $W_3$ is between 14–20 mm and $D_1$ is between 30–35 mm.

19. The vacuum cleaner of claim 1, wherein said inlet is directed tangentially with respect to said first cylindrical sidewall.

20. The vacuum cleaner of claim 1, wherein said sweeper is a structure selected from a group consisting of a wiper, a brush, a comb, bristles and any mixtures thereof.

21. The upright vacuum cleaner of claim 1 further including a back light between said dust collection assembly and said canister assembly.

22. A bagless vacuum cleaner, comprising:

a nozzle assembly;

a canister assembly pivotally mounted to said nozzle assembly;

a dust collection assembly carried by one of said nozzle assembly and said canister assembly, said dust collection assembly including a dust container and a filter;

a sweeper for sweeping across and cleaning dirt and debris from at least a portion of said filter; and a suction fan and suction fan drive motor carried on one of said nozzle assembly and said canister assembly.

23. An upright vacuum cleaner, comprising a nozzle assembly including a suction nozzle for picking up dirt and debris from a surface to be cleaned;

a canister assembly pivotally mounted to said nozzle assembly and including a control handle;

a bagless dust container, prefilter and primary filter for collecting dirt and debris cleaned from said surface;

a sweeper for cleaning said prefilter; and a suction fan and beltless drive motor carried on one of said nozzle assembly and said canister assembly for generating a vacuum airstream for drawing dirt and debris through said suction nozzle into said dust container.

24. The upright vacuum cleaner of claim 23, wherein said sweeper includes a rotor and at least one depending blade.

25. The upright vacuum cleaner of claim 24, wherein said at least one blade carries a wiper.

26. The upright vacuum cleaner of claim 24, wherein said at least one blade is swept in configuration.

27. The upright vacuum cleaner of claim 26, wherein said at least one blade has a sweep angle of between 0–30° and a radius of curvature of 35–40 mm.

28. The upright vacuum cleaner of claim 24, further including a bearing on said main body and a shoulder on said rotor for engaging said bearing.

29. The upright vacuum cleaner of claim 28, further including cooperating slots in said rotor and said bearing.

* * * * *